US009734777B2

(12) United States Patent
Park et al.

(10) Patent No.: US 9,734,777 B2
(45) Date of Patent: Aug. 15, 2017

(54) DISPLAY DEVICE

(71) Applicant: Samsung Display Co., Ltd., Yongin, Gyeonggi-Do (KR)

(72) Inventors: Hyung-Jun Park, Seongnam-si (KR); Byoung-Sun Na, Seoul (KR); Seong-Young Lee, Hwaseong-si (KR); Dong-Hyun Yoo, Hwaseong-si (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 177 days.

(21) Appl. No.: 14/587,788

(22) Filed: Dec. 31, 2014

(65) Prior Publication Data

US 2016/0035261 A1 Feb. 4, 2016

(30) Foreign Application Priority Data

Aug. 1, 2014 (KR) ..... 10-2014-0099275

(51) Int. Cl.

| | |
|---|---|
| ***G09G 3/20*** | (2006.01) |
| ***G09G 3/36*** | (2006.01) |
| ***G09G 3/00*** | (2006.01) |

(52) U.S. Cl.

CPC ..... *G09G 3/3614* (2013.01); *G09G 3/003* (2013.01); *G09G 2300/0413* (2013.01); *G09G 2330/06* (2013.01); *G09G 2340/0435* (2013.01)

(58) Field of Classification Search

CPC ..... G09G 3/3614; G09G 3/033; G09G 2340/0435; G09G 2330/06; G09G 2300/0413

See application file for complete search history.

(56) References Cited

U.S. PATENT DOCUMENTS

2005/0001806 A1* 1/2005 Ohmura ..... G09G 3/3614 345/92
2012/0098826 A1* 4/2012 Lee ..... G09G 3/003 345/419

(Continued)

FOREIGN PATENT DOCUMENTS

| | | | |
|---|---|---|---|
| CN | 104091577 A | * | 10/2014 |
| JP | 2011-027810 | | 2/2011 |
| KR | 1020090009583 A | | 1/2009 |

(Continued)

*Primary Examiner* — Andrew Sasinowski
*Assistant Examiner* — Brent D Castiaux
(74) *Attorney, Agent, or Firm* — Robert E. Bushnell, Esq.

(57) ABSTRACT

A display device that may be driven at both frequencies of 120 Hz and 240 Hz, includes a plurality of pixels arranged in a column direction and a row direction, a plurality of data lines connected with one of the pixels of a j-th row ('j' is a natural number) and one of the pixels of a (j+1)-th row in k-th column ('k' is a natural number), and connected with one of the pixels of a (j+2)-th row and one of the pixels of a (j+3)-th row in (k−1)-th column, a first gate circuit part configured to apply a gate signal to a (4m−3)-th gate line row ('m' is a natural number), a second gate circuit part configured to apply a gate signal to a (4m−2)-th gate line row, a third gate circuit part configured to apply a gate signal to a (4m−1)-th gate line row and a fourth gate circuit part configured to apply a gate signal to a 4m-th gate line row.

15 Claims, 12 Drawing Sheets

(56) References Cited

U.S. PATENT DOCUMENTS

2013/0194535 A1* 8/2013 Kim ..... G02F 1/13439
349/139
2013/0278570 A1* 10/2013 Park ..... G09G 5/00
345/204

FOREIGN PATENT DOCUMENTS

KR 1020120071885 A 7/2012
KR 1020130116700 A 10/2013

* cited by examiner

DISPLAY DEVICE

CLAIM OF PRIORITY

This application claims priority to and all benefits accruing under 35 U.S.C. §119 from Korean Patent Application No. 10-2014-0099275, filed on Aug. 1, 2014 in the Korean Intellectual Property Office ("KIPO"), the contents of which are herein incorporated by reference in their entireties.

BACKGROUND OF THE INVENTION

Field of the Invention

Exemplary embodiments of the present inventive concept relate to a display device. More particularly, exemplary embodiments of the present inventive concept relate to a display device capable of displaying three-dimensional ("3D") stereoscopic images.

Description of the Related Art

Generally, a liquid crystal display ("LCD") device displays two-dimensional ("2D") images. Recently, LCD devices capable of displaying three-dimensional ("3D") stereoscopic images have also been developed in order to meet an increasing demand in various fields, such as video games, movies, multimedia and other display fields.

Generally, as human eyes see the world from slightly different locations, the images sensed by the eyes are slightly different. This difference in the sensed images is called binocular parallax. Through the binocular parallax, a user of a stereoscopic image display device is able to view a 3D image.

Generally, a stereoscopic image may be displayed via a shutter-glasses technique or an auto-stereoscopic technique. Typical shutter-glasses techniques include an anaglyph technique, a liquid crystal ("LC") shutter-glasses technique and other various techniques. In the typical implementation of the anaglyph technique, glasses with blue and red color filters, one color for each eye, are worn by a viewer during viewing of the stereoscopic image. In the typical implementation of the LC shutter-glasses technique, a left image and a right image are alternated rapidly between a left LC shutter glass and a right LC shutter glass, each of the shutter glasses being synchronized to obstruct the undesired image and transmit the desired image. Thus, each eye sees only its appropriate perspective view i.e., the left eye sees only the left view and the right eye only the right view.

When three-dimensional ("3D") stereoscopic images are displayed, a driving method driving at a frequency of 120 Hz and a driving method driving at a frequency of 240 Hz have been used. A display device being driven by a driving method at a frequency of 120 Hz has a 1-dot-crossed pixel structure. A display device being driven by a driving method at a frequency of 240 Hz has a 1-dot-uncrossed pixel structure. When the 1-dot-crossed pixel structure is driven at a higher frequency, i.e. 240 Hz, a faulty vertical line may occur. When the 1-dot-uncrossed pixel structure is driven at a lower frequency, i.e. 120 Hz, a faulty horizontal line may occur. Therefore, display devices being driven by the driving method at a frequency of 120 Hz and display devices being driven by the driving method at a frequency of 240 Hz have been developed separately.

SUMMARY OF THE INVENTION

Exemplary embodiments of the present inventive concept provide a display device capable of being driven at both frequencies of 120 Hz and 240 Hz.

In an exemplary embodiment of a display device according to the present inventive concept, the display device includes a plurality of pixels arranged in a column direction and a row direction, one of a plurality of data lines connected with one of the pixels of a j-th row ('j' is a natural number) and one of the pixels of a (j+1)-th row in k-th column ('k' is a natural number), and connected with one of the pixels of a (j+2)-th row and one of the pixels of a (j+3)-th row in (k−1)-th column, a first gate circuit part configured to apply a gate signal to a (4m−3)-th gate line row ('m' is a natural number), a second gate circuit part configured to apply a gate signal to a (4m−2)-th gate line row, a third gate circuit part configured to apply a gate signal to a (4m−1)-th gate line row and a fourth gate circuit part configured to apply a gate signal to a 4m-th gate line row.

In an exemplary embodiment, the display device may further include a data driving part configured to apply data signals to the data lines.

In an exemplary embodiment, the data driving part may apply a data signal having a first polarity to an (n+1)-th data line ('n' is a natural number). The data driving part may apply a data signal having a second polarity to each of an n-th data line and an (n+2)-th data line adjacent to the (n+1)-th data line during one frame.

In an exemplary embodiment, a first clock-terminal signal of the first, the second, the third and the fourth gate circuit part may be a first, a second, a third and a fourth clock signal inverted every 4H ('H' is a horizontal period), respectively. A second clock-terminal signal of the first, the second, the third and the fourth gate circuit part may be a fifth, a sixth, a seventh and an eighth clock signal having a phase opposite to the first, the second, the third and the fourth clock signal respectively.

In an exemplary embodiment, the first, the second, the third and the fourth clock signal may be sequentially delayed by 1H.

In an exemplary embodiment, a first, a second, a third and a fourth clock signal inverted every 2H ('H' is a horizontal period) may be applied to the first, the second, the third and the fourth gate circuit part respectively. A fifth, a sixth, a seventh and an eighth clock signal having a phase opposite to the first, the second, the third and the fourth clock signal may be applied to the first, the second, the third and the fourth gate circuit part respectively.

In an exemplary embodiment, the first clock signal and the second clock signal may be applied simultaneously. The third clock signal and the fourth clock signal may be delayed by 1H with respect to the first clock signal and the second clock signal.

In an exemplary embodiment, the first, the second, the third and the fourth gate circuit part may include an amorphous silicon gate (ASG).

In an exemplary embodiment, the first, the second, the third and the fourth gate circuit part may include an integrated circuit (IC).

In an exemplary embodiment of a display device according to the present inventive concept, the display device includes a plurality of pixels arranged in a column direction and a row direction, a plurality of data lines connected with one of the pixels of a j-th row ('j' is a natural number), one of the pixels of a (j+1)-th row, one of the pixels of a (j+2)-th row and one of the pixels of a (j+3)-th row in k-th column ('k' is a natural number), and connected with one of the pixels of a (j+4)-th row, one of the pixels of a (j+5)-th row, one of the pixels of a (j+6)-th row and one of the pixels of a (j+7)-th row in (k−1)-th column, a first gate circuit part configured to apply a gate signal to a (4m−3)-th gate line row ('m' is a natural number), a second gate circuit part configured to apply a gate signal to a (4m−2)-th gate line row, a third gate circuit part configured to apply a gate signal to a (4m−1)-th gate line row and a fourth gate circuit part configured to apply a gate signal to a 4m-th gate line row.

In an exemplary embodiment, the display device may further include a data driving part configured to apply data signals to the data lines.

In an exemplary embodiment, the data driving part may apply a data signal having a first polarity to an (n+1)-th data line ('n' is a natural number). The data driving part may apply a data signal having a second polarity to each of an n-th data line and an (n+2)-th data line adjacent to the (n+1)-th data line during one frame.

In an exemplary embodiment, a first clock-terminal signal of the first, the second, the third and the fourth gate circuit part may be a first, a second, a third and a fourth clock signal inverted every 4H ('H' is a horizontal period) respectively. A second clock-terminal signal of the first, the second, the third and the fourth gate circuit part may be a fifth, a sixth, a seventh and an eighth clock signal having a phase opposite to the first, the second, the third and the fourth clock signal respectively.

In an exemplary embodiment, the first, the second, the third and the fourth clock signal may be sequentially delayed by 1H.

In an exemplary embodiment, a first, a second, a third and a fourth clock signal inverted every 2H ('H' is a horizontal period) may be applied to the first, the second, the third and the fourth gate circuit part respectively. A fifth, a sixth, a seventh and an eighth clock signal having a phase opposite to the first, the second, the third and the fourth clock signal may be applied to the first, the second, the third and the fourth gate circuit part respectively.

In an exemplary embodiment, the first clock signal and the second clock signal may be applied simultaneously. The third clock signal and the fourth clock signal may be delayed by 1H with respect to the first clock signal and the second clock signal.

In an exemplary embodiment, the first, the second, the third and the fourth gate circuit part may include an amorphous silicon gate (ASG).

In an exemplary embodiment, the first, the second, the third and the fourth gate circuit part may include an integrated circuit (IC).

According to the present exemplary embodiment, the display device has a multiple of 2-dot-crossed pixel structures and a plurality of 4 gate circuits. In addition, the display device is driven by a method in which each of the clock signals is sequentially delayed by 1H and a method in which every two subsequent clock signals of the clock signals are sequentially delayed by 1H. Therefore, the display device may be driven at both frequencies of 120 Hz and 240 Hz.

BRIEF DESCRIPTION OF THE DRAWINGS

The above and other features and advantages of the present inventive concept will become more apparent by describing in detailed exemplary embodiments thereof with reference to the accompanying drawings, in which.

DETAILED DESCRIPTION OF THE INVENTION

Hereinafter, the present invention will be explained in detail with reference to the accompanying drawings.

Figure 1:
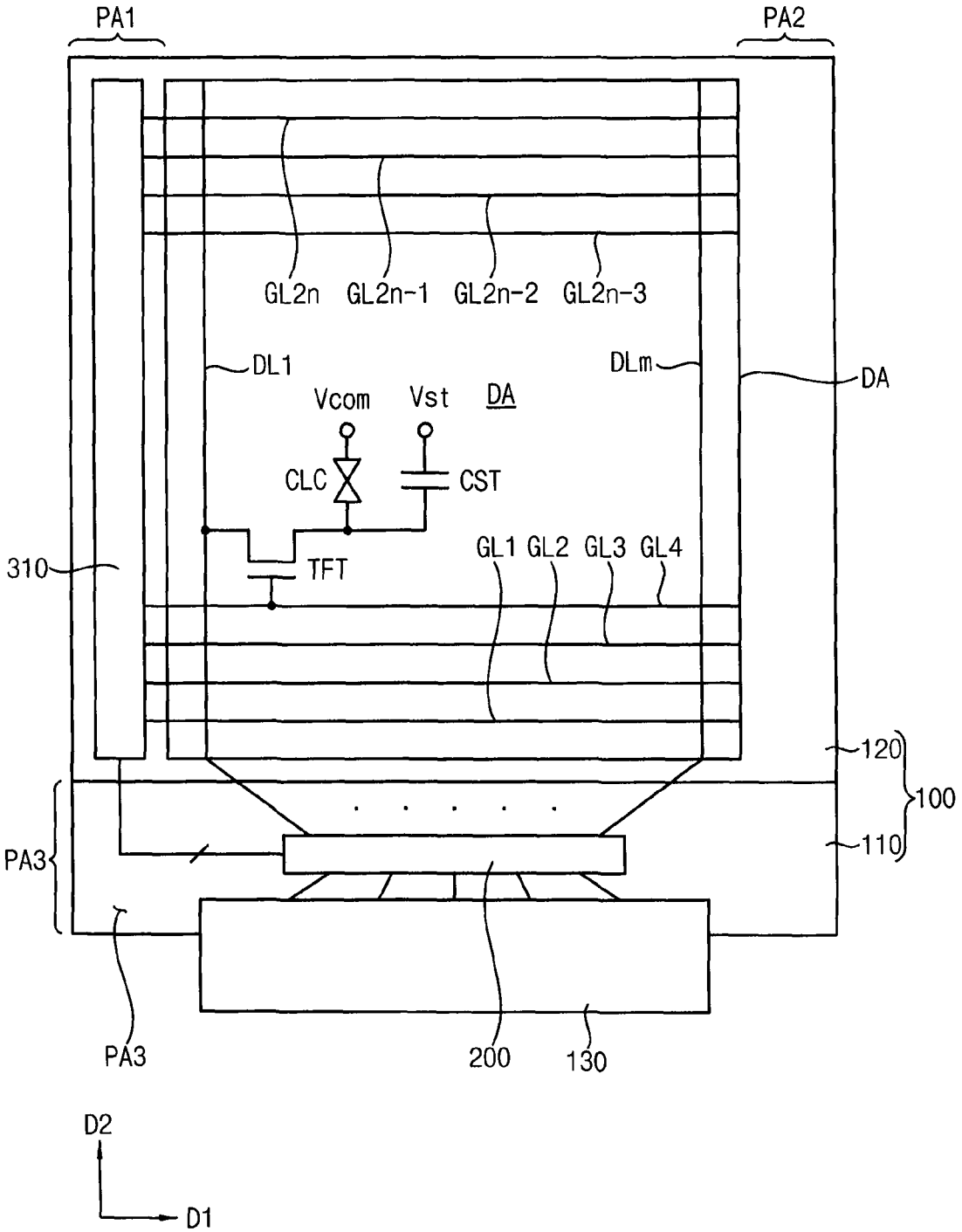
FIG. 1 is a plan view illustrating a display device according to an exemplary embodiment of the present inventive concept.
Figure 2:
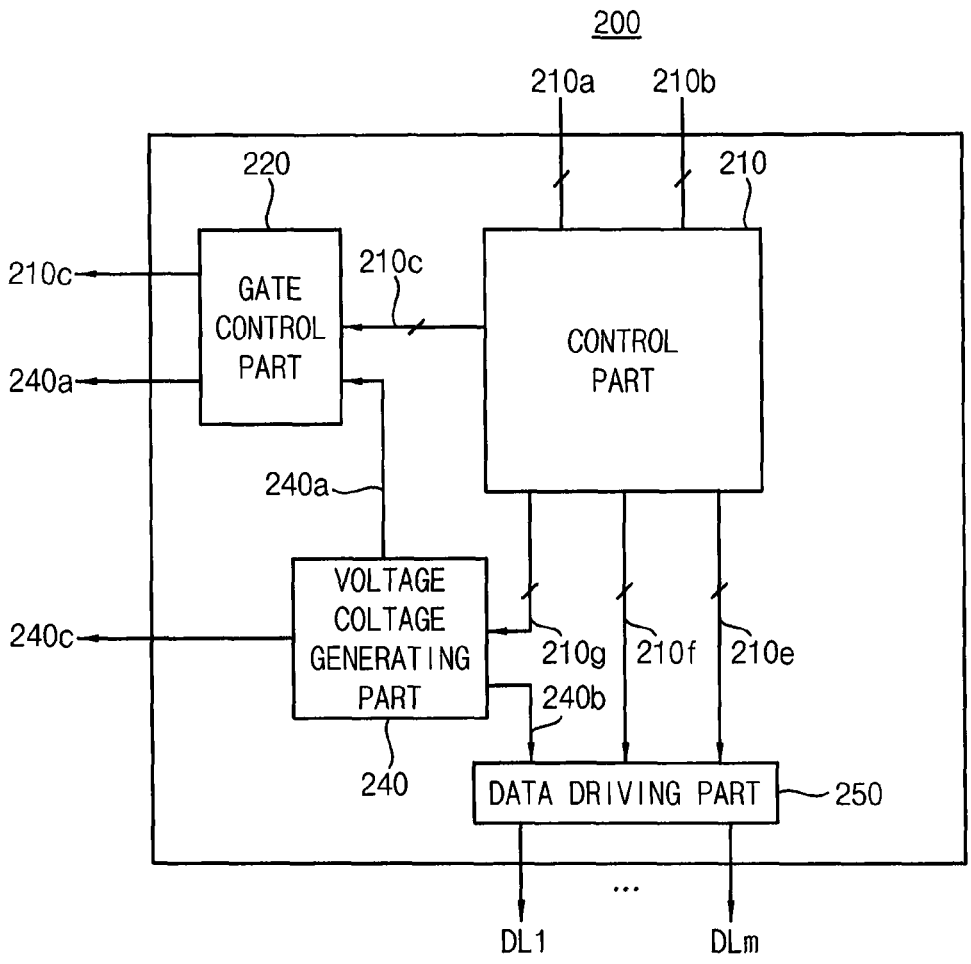
FIG. 2 is a block diagram illustrating a driving part of FIG. 1.

FIG. 1 is a plan view illustrating a display device according to an exemplary embodiment of the present inventive concept. FIG. 2 is a block diagram illustrating a driving part of FIG. 1.

Referring to FIGS. 1 and 2, a display device according to an exemplary embodiment of the present inventive concept includes a display panel 100, a driving circuit part and a flexible printed circuit board 130. The driving circuit part may include a driving part 200 and a gate driving part 310. The flexible printed circuit board 130 may be connected between the driving circuit part and an external system.

The display panel 100 may include an array substrate 110, a color filter substrate 120 opposite to the array substrate 110 and a liquid crystal layer (not shown) interposed between the array substrate 110 and the color filter substrate 120. The display panel 100 may include a display area DA which displays an image and a peripheral area PA which surrounds the display area DA.

A plurality of gate lines GL1 to GL2*n* ('n' is a natural number) and a plurality of data lines DL1 to DLm ('m' is a natural number) crossing the 2n gate lines GL1 to GL2*n* are formed on the array substrate 110 within the display area DA. A plurality of pixels is formed within the display area DA. Each of the pixels is electrically connected to one of the gate lines GL1 to GL2*n* and one of the data lines DL1 to DLm. Each of the pixels includes a thin-film transistor (TFT), a liquid crystal capacitor CLC and a storage capacitor CST. A gate electrode and a source electrode of the thin-film transistor TFT is electrically connected with a gate line GL and a data line DL respectively. A drain electrode of the thin-film transistor TFT is electrically connected with the liquid crystal capacitor CLC and the storage capacitor CST.

The peripheral area PA may include a first peripheral area PA1, a second peripheral area PA2 and a third peripheral area PA3. The first peripheral area PA1 may be disposed at a left side of the display area DA, adjacent to an end of the gate lines GL1 to GL2*n* (FIG. 1). The second peripheral area PA2 may be disposed at a right side the display area DA, adjacent to the other end of the gate lines GL1 to GL2*n* (FIG. 1). The third peripheral area PA3 may be disposed at a bottom side of the display area DA, adjacent to an end of the data lines DL1 to DLm (FIG. 1).

The driving part 200 may be formed as a chip mounted at the third peripheral area PA3. An original image data 210*a* and synchronization signals 210*b* may be applied to the driving part 200 through the flexible printed circuit board 130.

The driving part 200 may include a control part 210, a gate control part 220, a voltage generating part 240 and a data driving part 250.

The original image data 210*a* and the synchronization signals 210*b* may be applied to the control part 210 through the flexible printed circuit board 130. The synchronization signals 210*b* may include a vertical synchronization signal Vsync, a horizontal synchronization signal Hsync, a main clock signal MCLK and a data enable signal DE. The control part 210 may generate gate control signals 210*c* and data control signals 210*e* based on the synchronization signals 210*b* to provide to the gate control part 220 and the data driving part 250 respectively. The control part 210 may provide the data driving part 250 with image data 210*f* based on the original image data 210*a*.

In addition, the control part 210 may generate a voltage control signal 210*g* for controlling the voltage generating part 240.

The voltage generating part 240 may generate a driving voltage using a power voltage from an external device to provide to each part. For example, the voltage generating part 240 generates a gate voltage 240*a* including an off voltage VOFF to be provided to the gate control part 220. The voltage generating part 240 generates a gamma reference voltage 240*b* to be provided to the data control part 220. The voltage generating part 240 generates a common voltage 240*c* to be provided to a common electrode of the color filter substrate 120.

The gate control part 220 provides the gate driving part 310 with the gate control signals 210*c* and the gate voltage 240*a*. The gate control signals 210*c* may include a first vertical start signal STV1, a second vertical start signal STV2, a third vertical start signal STV3, a fourth vertical start signal STV4, a first clock signal CLK1, a second clock signal CLK2, a third clock signal CLK3, a fourth clock signal CLK4, a fifth clock signal CLK5, a sixth clock signal CLK6, a seventh clock signal CLK7 and an eighth clock signal CLK8.

The data driving part 250 may convert the image data 240*f* to analog data voltage based on the gamma reference voltage 240*b* to be outputted to the data lines DL1 to DLm in synchronization with a timing of the data control signal 210*e*.

As described above, the driving part 200 may provide the data lines DL1 to DLm with a data voltage and control signals to drive the gate driving part 310.

The gate driving part 310 may be disposed at the first peripheral area PA1 as an integrated circuit. The gate driving part 310 may provide odd-numbered gate lines with a gate signal based on the gate control signals 210*c* and the gate voltage 240*a*. The gate driving part 310 may include a plurality of stages and a first, a second, a third and a fourth gate circuit part. However, the present inventive concept is not limited thereto. Alternatively, the gate driving part 310 may be formed as an amorphous silicon gate (ASG).

Figure 3:
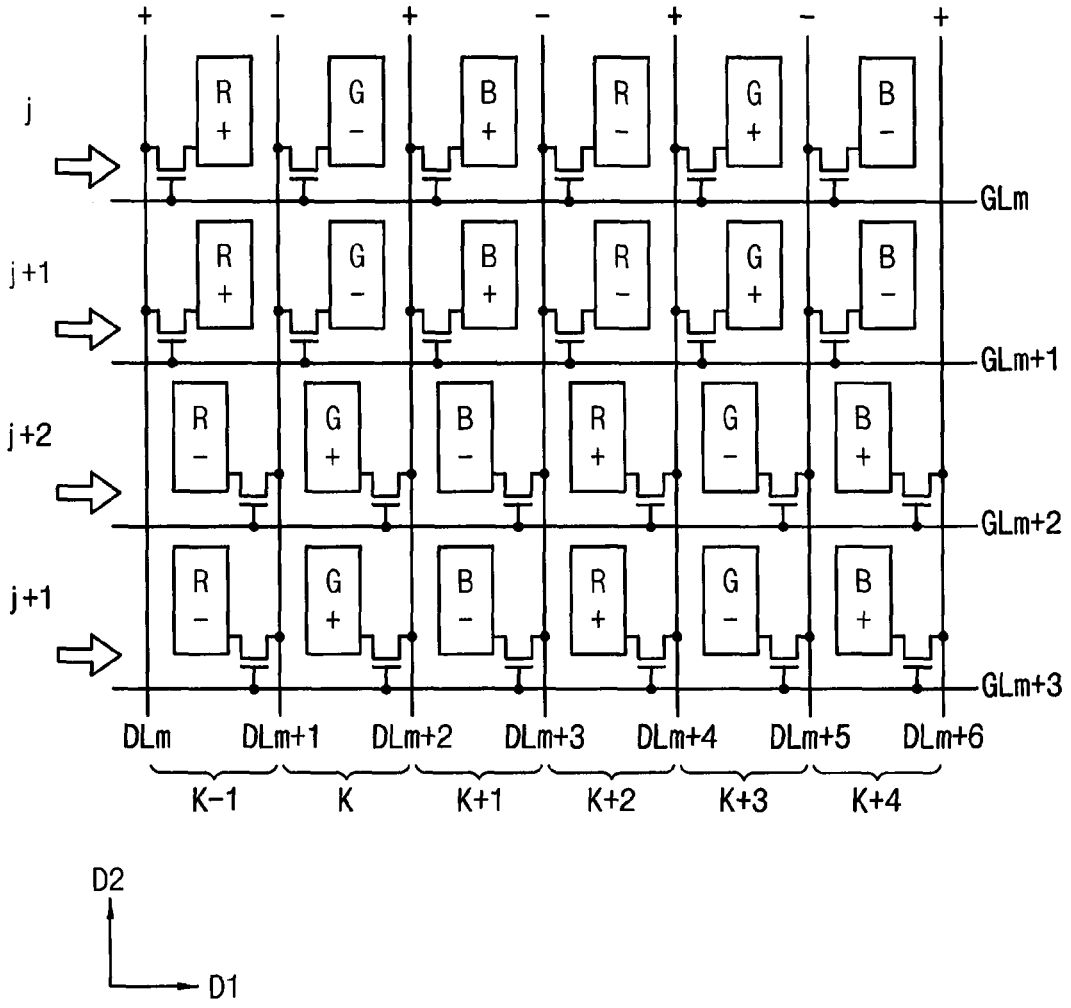
FIG. 3 is a schematic diagram illustrating a structure of a pixel of a display device according to the inventive concept.

FIG. 3 is a schematic diagram illustrating a structure of a pixel of a display device according to the inventive concept.

Referring to FIG. 3, a display panel 100 according to an exemplary embodiment of the present inventive concept includes a plurality of pixels which are arranged in a first direction D1 and a second direction D2 crossing the first direction D1. The pixels may include a red pixel (R), a green pixel (G) and a blue pixel (B). Each of the red, green, and blue pixels is periodically disposed on the display panel 100.

The data lines are extended in the second direction D2 that is a direction of a shorter side of the display panel 100 when compared to the first direction D1, and the data lines are arranged in the first direction D1.

An (m+1)-th data line is connected with one of the pixels of a j-th row ('j' is a natural number) and one of the pixels of a (j+1)-th row in k-th column ('k' is a natural number). In addition, the (m+1)-th data line is connected with one of the pixels of a (j+2)-th row and one of the pixels of a (j+3)-th row in (k−1)-th column. In the present exemplary embodiment, a connecting structure of the (m+1)-th data line DLm+1 is periodically repeated.

The data driving part 250 respectively applies data signals to a plurality of data lines formed on the display panel 100. For example, during an N-th frame, the data driving part 250 applies a data signal of a negative polarity (−) to the (m+1)-th data line DLm+1, and applies a data signal of a positive polarity (+) to the m-th data line DLm and an (m+2)-th data line DLm+2 adjacent to the (m+1)-th data line DLm+1, respectively.

Accordingly, a data voltage having different polarities in a sequence such as "+, +, −, −, +, +, −, −" is applied to a pixel row, and a data voltage having different polarities in a sequence such as "+, −, +, −, +, −" is applied to a pixel column.

In the present exemplary embodiment, a first gate signal is applied to an n-th gate line GLn and a second gate signal delayed by 1H with respect to the first gate signal applied to a (n+1)-th gate line GLn+1. Thus, the gate signals may be sequentially delayed by 1H.

In the present exemplary embodiment, the display panel 100 according to an exemplary embodiment of the present inventive concept has a 2-dot-crossed pixel structure. However, the present inventive concept is not limited thereto. Alternatively, the display panel 100 may have a multiple of 2-dot-crossed pixel structures.

Figure 4:
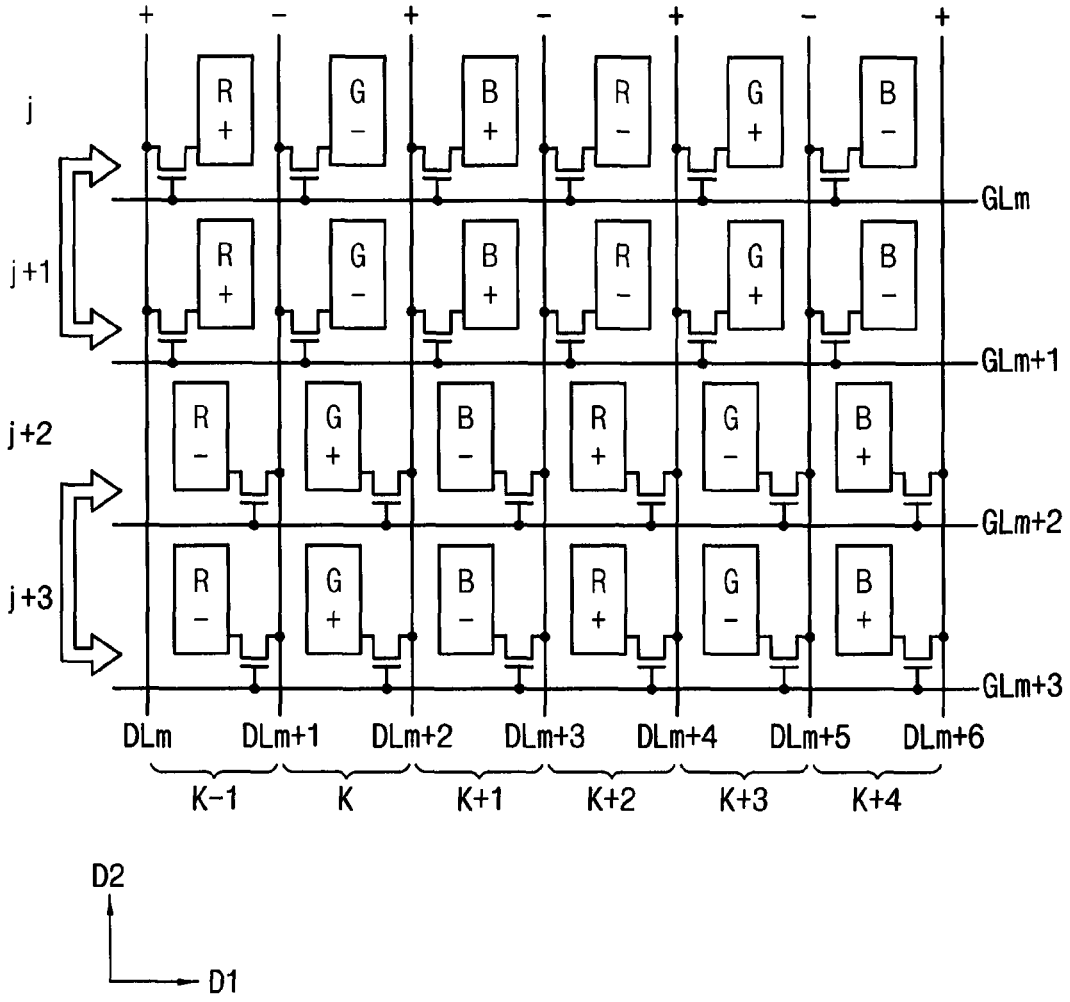
FIG. 4 is a schematic diagram illustrating a structure of a pixel of a display device according to the inventive concept.

FIG. 4 is a schematic diagram illustrating a structure of a pixel of a display device according to the inventive concept.

Referring to FIG. 4, a display panel 100 according to an exemplary embodiment of the present inventive concept includes a plurality of pixels which are arranged in the first direction D1 and the second direction D2 crossing the first direction D1. The pixels may include a red pixel (R), a green pixel (G) and a blue pixel (B). Each of the red, green, and blue pixels is periodically disposed on the display panel 100.

The data lines are extended in the second direction D2 that is a direction along a shorter side of the display panel 100 to be arranged in the first direction D1.

An (m+1)-th data line is connected with one of the pixels of a j-th row ('j' is a natural number) and one of the pixels of a (j+1)-th row in k-th column ('k' is a natural number). In addition, the (m+1)-th data line is connected with one of the pixels of a (j+2)-th row and one of the pixels of a (j+3)-th row in (k−1)-th column. In the present exemplary embodiment, a connecting structure of the (m+1)-th data line DLm+1 is periodically repeated.

The data driving part 250 respectively applies data signals to a plurality of data lines formed on the display panel 100. For example, during an N-th frame, the data driving part 250 applies a data signal of a negative polarity (−) to an (m+1)-th data line DLm+1, and applies a data signal of a positive polarity (+) to an m-th data line DLm and an (m+2)-th data line DLm+2 adjacent to the (m+1)-th data line DLm+1, respectively.

Accordingly, a data voltage having different polarities in a sequence such as "+, +, −, −, +, +, −, −" is applied to a pixel row, and a data voltage having different polarities in a sequence such as "+, −, +, −, +, −" is applied to a pixel column.

In the present exemplary embodiment, a first gate signal is applied to an n-th gate line GLn and an (n+1)-th gate line GLn+1. In addition, a second gate signal delayed by 1H with respect to the first gate signal is applied to an (n+2)-th gate line GLn+2 and an (n+3)-th gate line GLn+3. Thus, gate signals of every two subsequent gate lines may be sequentially delayed by 1H.

In the present exemplary embodiment, the display panel 100 according to an exemplary embodiment of the present inventive concept has a 2-dot-crossed pixel structure. However, the present inventive concept is not limited thereto. Alternatively, the display panel 100 may have a multiple of 2-dot-crossed pixel structures.

Figure 5:
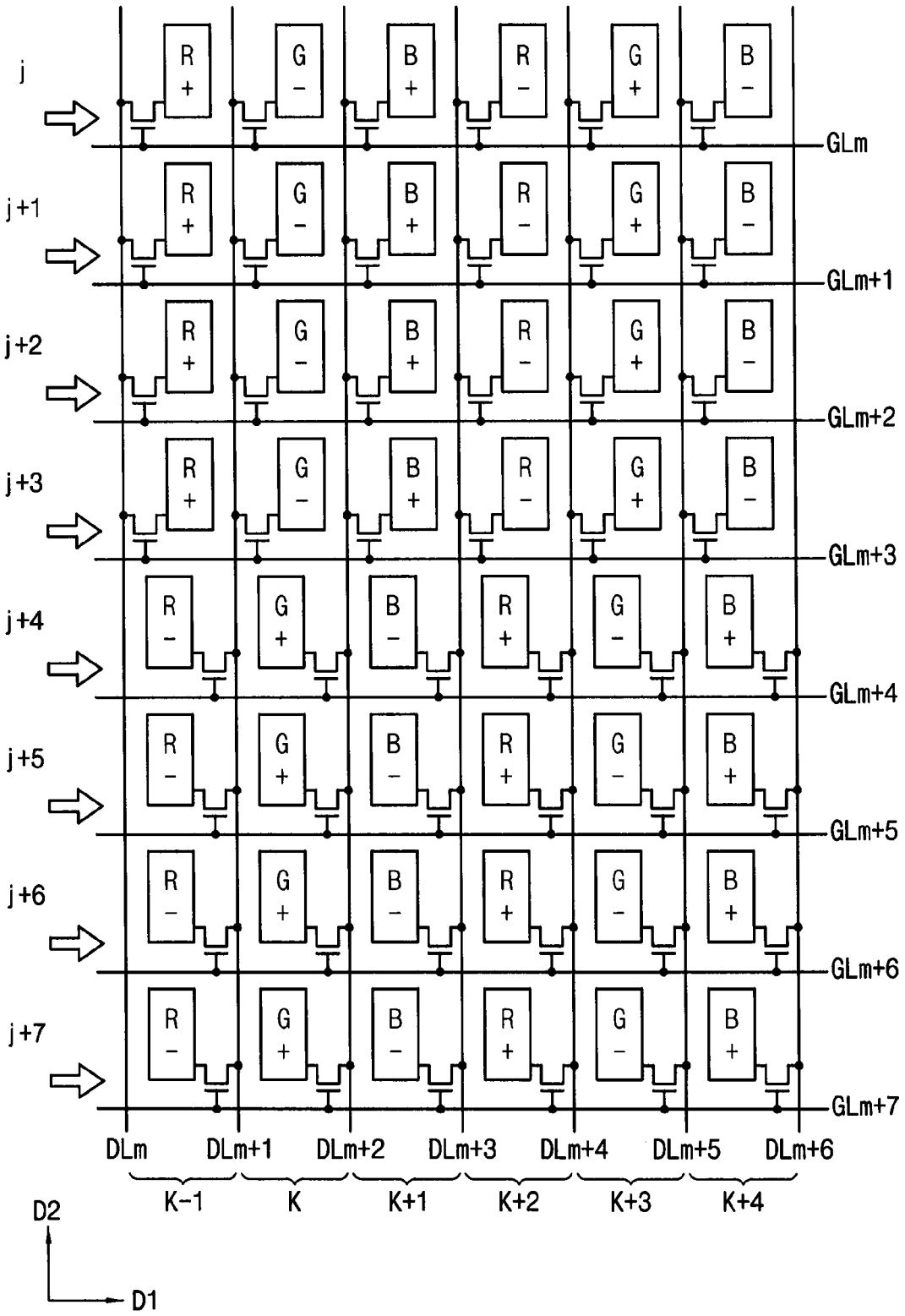
FIG. 5 is a schematic diagram illustrating a structure of a pixel of a display device according to the inventive concept.

FIG. 5 is a schematic diagram illustrating a structure of a pixel of a display device according to the inventive concept.

Referring to FIG. 5, a display panel 100 according to an exemplary embodiment of the present inventive concept includes a plurality of pixels which are arranged in the first direction D1 and the second direction D2 crossing the first direction D1. The pixels may include a red pixel (R), a green pixel (G) and a blue pixel (B). Each of the red, green, and blue pixels is periodically disposed on the display panel 100.

The data lines are extended in the second direction D2 that is a direction along a shorter side of the display panel 100 to be arranged in the first direction D1.

An (m+1)-th data line is connected with one of the pixels of a j-th row ('j' is a natural number), one of the pixels of a (j+1)-th row, one of the pixels of a (j+2)-th row and one of the pixels of a (j+3)-th row in k-th column ('k' is a natural number). In addition, the (m+1)-th data line is connected with one of the pixels of a (j+4)-th row, one of the pixels of a (j+5)-th row, one of the pixels of a (j+6)-th row and one of the pixels of a (j+7)-th row in (k−1)-th column. In the present exemplary embodiment, a connecting structure of the (m+1)-th data line DLm+1 is periodically repeated.

The data driving part 250 respectively applies data signals to a plurality of data lines formed on the display panel 100. For example, during an N-th frame, the data driving part 250 applies a data signal of a negative polarity (−) to an (m+1)-th data line DLm+1, and applies a data signal of a positive polarity (+) to an m-th data line DLm and an (m+2)-th data line DLm+2 adjacent to the (m+1)-th data line DLm+1, respectively.

Accordingly, a data voltage having different polarities in a sequence such as "+, +, +, +, −, −, −, −" is applied to a pixel row, and a data voltage having different polarities in a sequence such as "+, −, +, −, +, −" is applied to a pixel column.

In the present exemplary embodiment, a first gate signal is applied to an n-th gate line GLn and a second gate signal delayed by 1H with respect to the first gate signal is applied to an (n+1)-th gate line GLn+1. Thus, the gate signals may be sequentially delayed by 1H.

In the present exemplary embodiment, the display panel 100 according to an exemplary embodiment of the present inventive concept has a 4-dot-crossed pixel structure. However, the present inventive concept is not limited thereto. Alternatively, the display panel 100 may have a multiple of 2-dot-crossed pixel structures.

Figure 6:
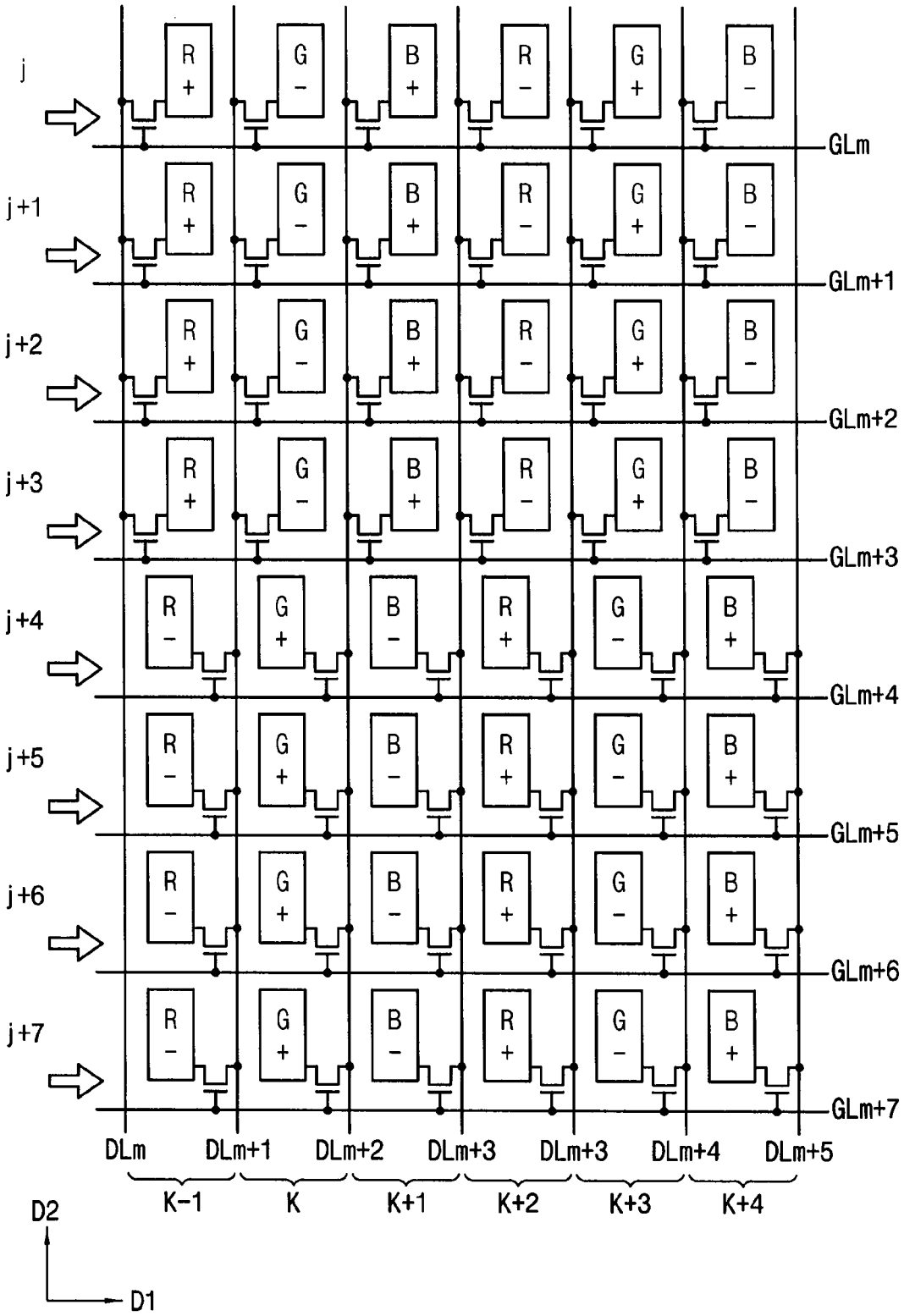
FIG. 6 is a schematic diagram illustrating a structure of a pixel of a display device according to the inventive concept.

FIG. 6 is a schematic diagram illustrating a structure of a pixel of a display device according to the inventive concept.

Referring to FIG. 6, a display panel 100 according to an exemplary embodiment of the present inventive concept includes a plurality of pixels which are arranged in the first direction D1 and the second direction D2 crossing the first direction D1. The pixels may include a red pixel (R), a green pixel (G) and a blue pixel (B). Each of the red, green, and blue pixels is periodically disposed on the display panel 100.

The data lines are extended in the second direction D2 that is a direction along a shorter side of the display panel 100 and are arranged in the first direction D1.

An (m+1)-th data line is connected with one of the pixels of a j-th row ('j' is a natural number), one of the pixels of a (j+1)-th row, one of the pixels of a (j+2)-th row and one of the pixels of a (j+3)-th row in k-th column ('k' is a natural number). In addition, the (m+1)-th data line is connected with one of the pixels of a (j+4)-th row, one of the pixels of a (j+5)-th row, one of the pixels of a (j+6)-th row and one of the pixels of a (j+7)-th row in (k−1)-th column. In the present exemplary embodiment, a connecting structure of the (m+1)-th data line DLm+1 is periodically repeated.

The data driving part 250 respectively applies data signals to a plurality of data lines formed on the display panel 100. For example, during an N-th frame, the data driving part 250 applies a data signal of a negative polarity (−) to an (m+1)-th data line DLm+1, and applies a data signal of a positive polarity (+) to an m-th data line DLm and an (m+2)-th data line DLm+2 adjacent to the (m+1)-th data line DLm+1, respectively.

Accordingly, a data voltage having different polarities in a sequence such as "+, +, +, +, −, −, −, −" is applied to a pixel row, and a data voltage having different polarities in a sequence such as "+, −, +, −, +, −" is applied to a pixel column.

In the present exemplary embodiment, a first gate signal is applied to an n-th gate line GLn and an (n+1)-th gate line GLn+1. In addition, a second gate signal delayed by 1H with respect to the first gate signal is applied to an (n+2)-th gate line GLn+2 and an (n+3)-th gate line GLn+3. Thus, the gate signals may be sequentially delayed by 1H every two gate lines.

In the present exemplary embodiment, the display panel 100 according to an exemplary embodiment of the present inventive concept has a 4-dot-crossed pixel structure. However, the present inventive concept is not limited thereto. Alternatively, the display panel 100 may have a multiple of 2-dot-crossed pixel structures.

FIGS. 7 to 10 are block diagrams illustrating a gate driving part of FIG. 1.

The gate driving part 310 according to an exemplary embodiment of the present inventive concept a first to an (n+4)-th stage SRC1 to SRCn+4. The first to the n-th stage SRC1 to SRCn may be defined as a driving stage. The (n+1)-th stage to the (n+4)-th stage SRCn+1 to SRCn+4 may be defined as a dummy stage. A plurality of wirings may be formed at a side of the first to the (n+4)-th stage SRC1 to SRCn+4. The gate control signals 210*c* including a first vertical start signal STV1, a second vertical start signal STV2, a third vertical start signal STV3, a fourth vertical start signal STV4, a first clock signal CLK1, a second clock signal CLK2, a third clock signal CLK3 and a fourth clock signal CLK4 and the off voltage VOFF may be applied to the wirings. In addition, the wirings may be electrically connected with corresponding stage through a connecting line.

Hereinafter, for convenience of description, a first gate circuit 310*a*, a second gate circuit 310*b*, a third gate circuit 310*c* and a fourth gate circuit 310*d* are illustrated respectively. However, the first to the (n+4)-th stage, i.e. SRC1 to SRCn+4, may be sequentially disposed according to an order of a corresponded gate line. For example, the first to the (n+4)-th stage, i.e. SRC1 to SRCn+4, are sequentially disposed and formed.

Figure 7:
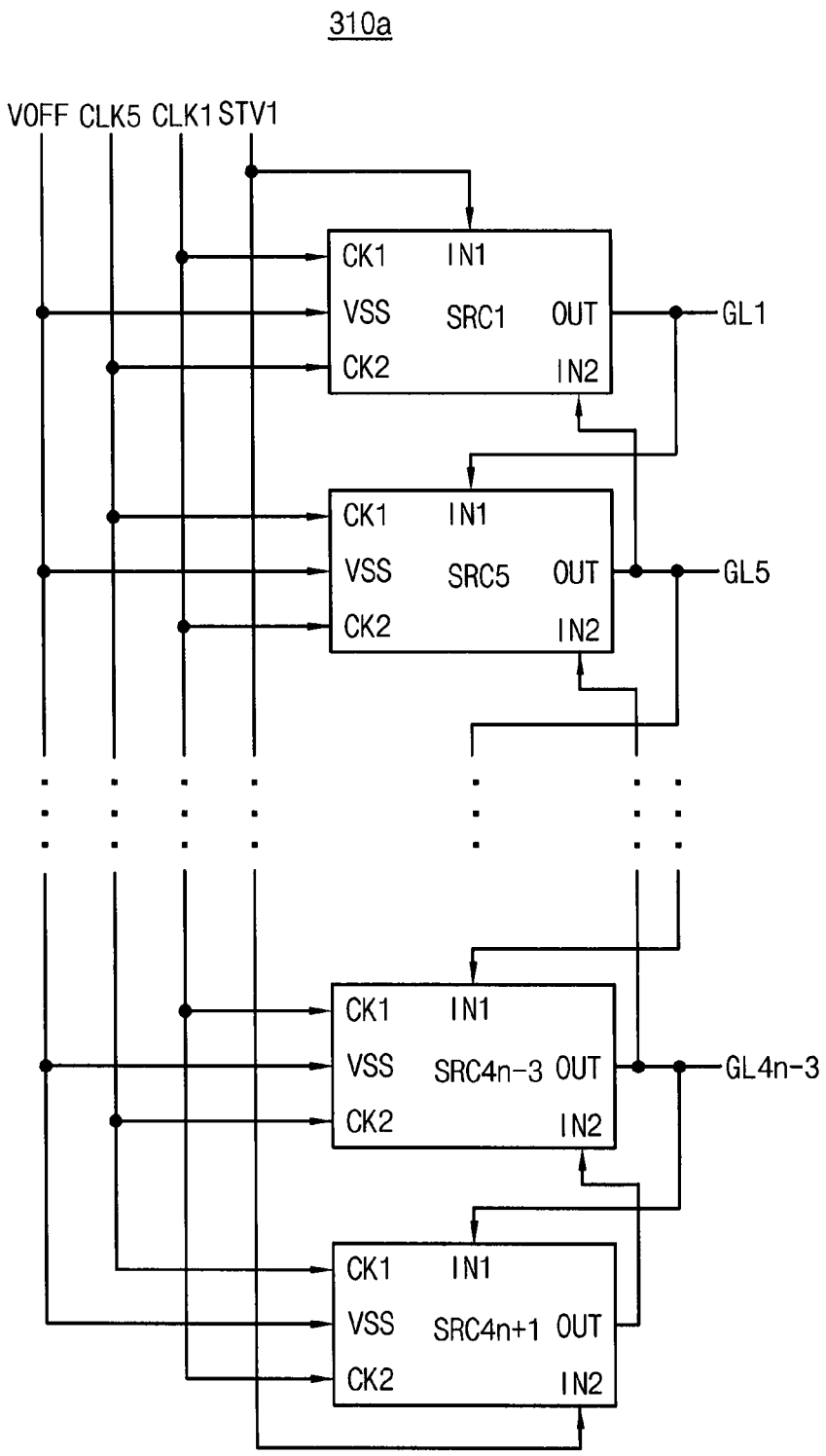
FIGS. 7 to 10 are block diagrams illustrating a gate driving part of FIG. 1.

Referring to FIG. 7, the first gate circuit 310*a* may be defined as (4t−3)-th stages ('t' is a natural number) cascade-connected one by one from the first to the (n+4)-th stage (i.e. SRC1 to SRCn+4) of the gate driving part 310. In addition, (n+1)-th stage SRCn+1 is a last stage. The (n+1)-th stage SRCn+1 is a dummy stage.

Each stage of the first gate circuit 310*a* may include a first input terminal IN1, a second input terminal IN2, a first clock terminal CK1, a second clock terminal CK2, a power terminal VSS and an output terminal OUT. An off voltage VOFF may be applied to the power terminal VSS.

A first clock signal CLK1 and a fifth clock signal CLK5 may be applied alternately to the first clock terminal CK1 and the second clock terminal CK2. The fifth clock signal CLK5 has a phase opposite to the first clock signal CLK1. For example, the first clock signal CLK1 and the fifth clock signal CLK5 are applied to the first clock terminal CK1 and the second clock terminal CK2 respectively in an odd-numbered stage. The fifth clock signal CLK5 and the first clock signal CLK1 are applied to the first clock terminal CK1 and the second clock terminal CK2 respectively in an even-numbered stage.

The output terminal OUT may output a gate signal based on a signal of the first clock terminal CK1. For example, the output terminal OUT of the odd-numbered stage outputs a gate signal based on the first clock signal CLK1 applied to the first clock terminal CK1. The output terminal OUT of the even-numbered stage outputs a gate signal based on the fifth clock signal CLK5 applied to the first clock terminal CK1. Output terminals OUT of driving stages is connected with a (4k−3)-th gate line ('k' is a natural number) of the gate lines of the display panel 100.

An output signal of the previous stage may be provided to the first input terminal IN1. An output signal of the next stage may be provided to the second input terminal IN2. For example, a gate signal from the output terminal OUT of the previous stage is provided to the first input terminal IN1. A gate signal from the output terminal OUT of the next stage is provided to the second input terminal IN2. In addition, a first vertical start signal STV1 is provided to the first input terminal IN1 of the first stage SRC1 and the second input terminal IN2 of the (n+1)-th stage SRCn+1.

As explained above, the first gate circuit 310*a* includes a plurality of stages. The first gate circuit 310*a* provides the (4k−3)-th gate line with gate signal based on the first clock signal CLK1, the fifth clock signal CLK5, the first vertical start signal STV1 and the off voltage VOFF.

The second gate circuit 310*b*, the third gate circuit 310*c* and the fourth gate circuit 310*d* have the same stage organization as the first gate circuit 310*a*. However, the second gate circuit 310*b*, the third gate circuit 310*c* and the fourth gate circuit 310*d* have a difference in control signal with respect to the first gate circuit 310*a*. Thus, for convenience of description, the difference with respect to the first gate circuit 310*a* will be mainly explained.

Figure 8:
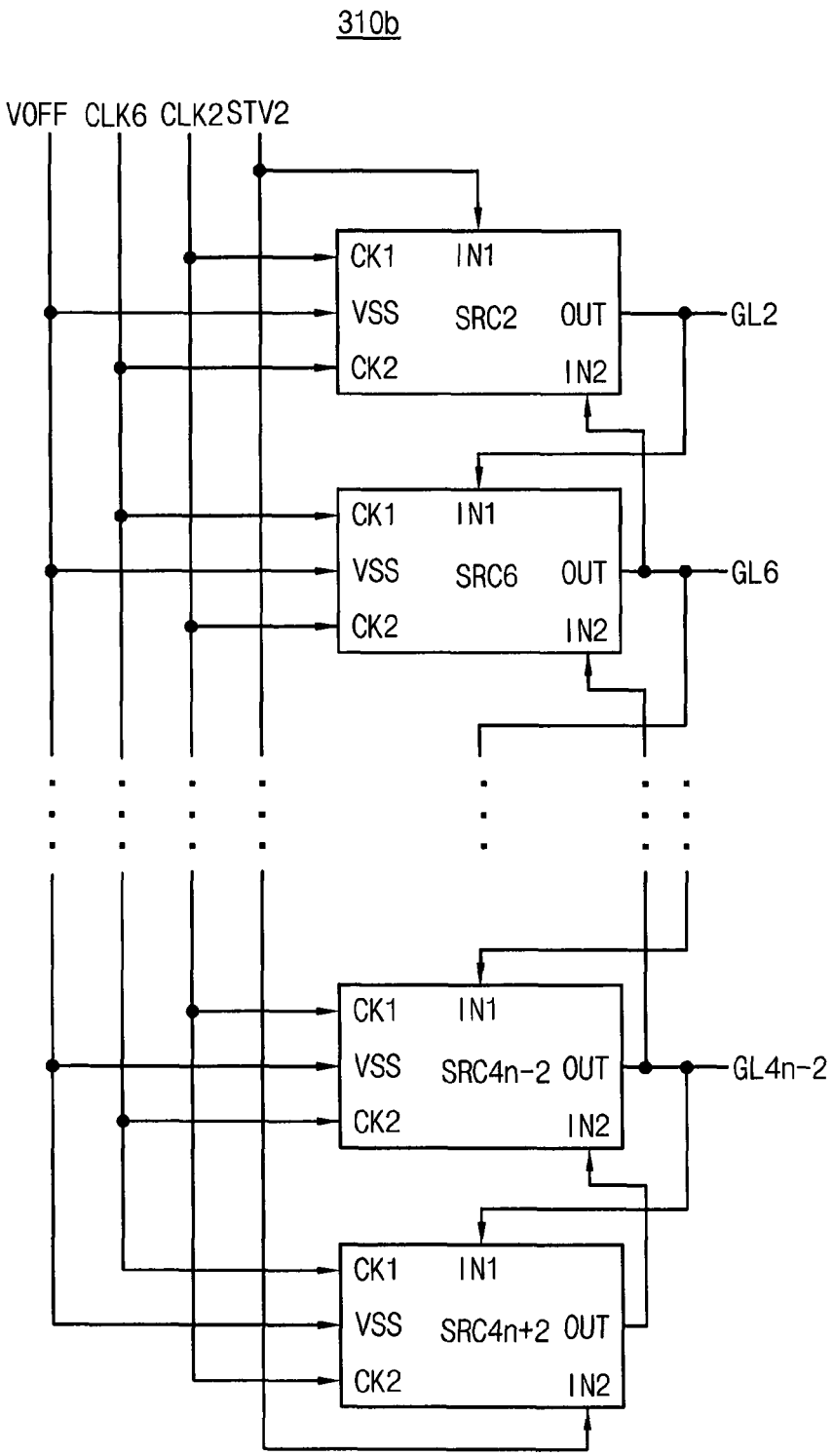

Referring to FIG. 8, the second gate circuit 310*b* may be defined as (4t−2)-th stages ('t' is a natural number) cascade-connected one by one from the first to the (n+4)-th stage (i.e. SRC1 to SRCn+4) of the gate driving part 310. In addition, a last stage is (n+2)-th stage SRCn+2. The (n+2)-th stage SRCn+2 is a dummy stage.

The second gate circuit 310*b* includes a plurality of stages. The second gate circuit 310*b* provides the (4k−2)-th gate line with a gate signal based on the second clock signal CLK2, the sixth clock signal CLK6, the second vertical start signal STV2 and the off voltage VOFF. The sixth clock signal CLK6 has a phase opposite to the second clock signal CLK2.

Figure 9:
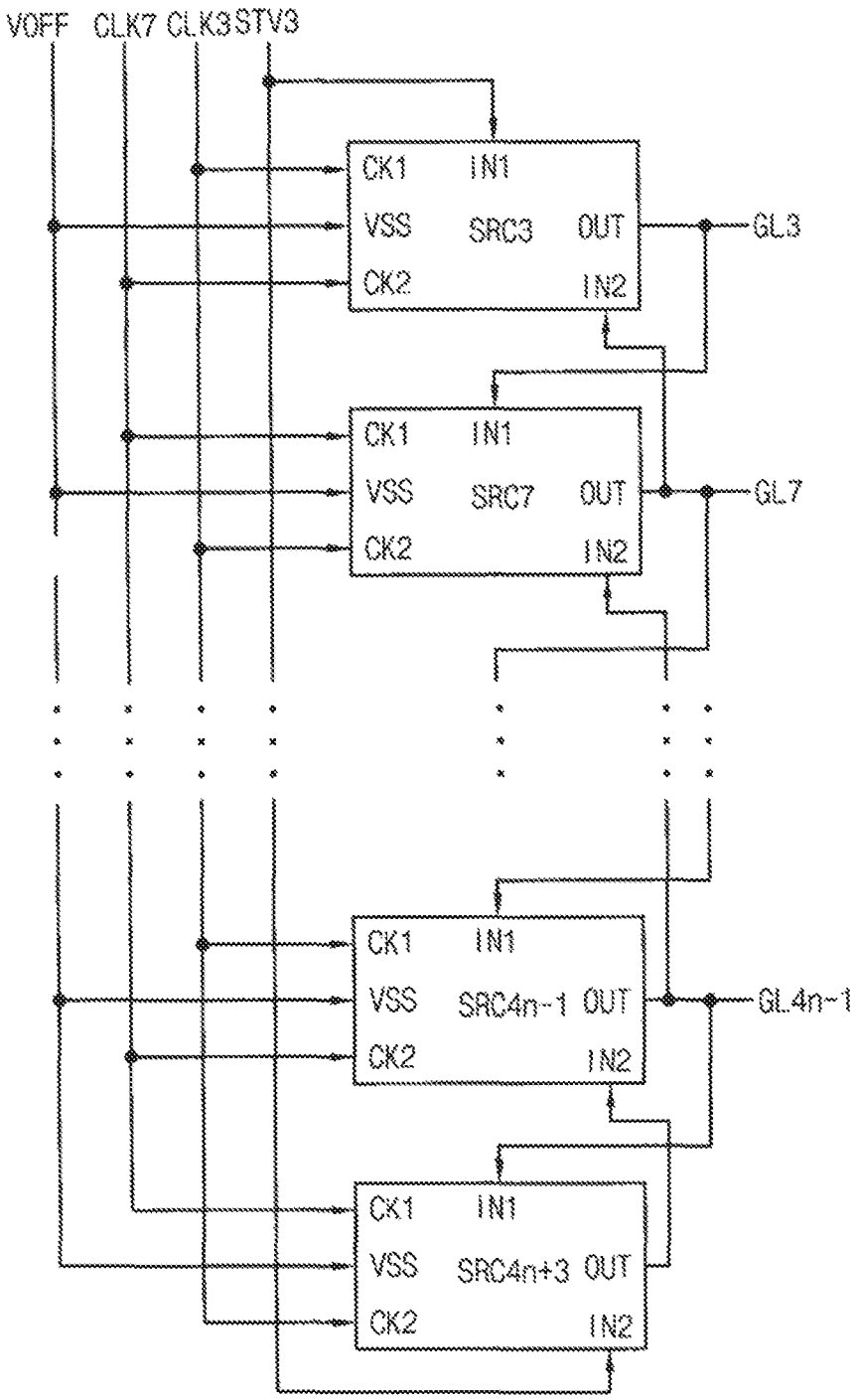

Referring to FIG. 9, the third gate circuit 310*c* may be defined as (4t−1)-th stages ('t' is a natural number) cascade-connected one by one from the first to the (n+4)-th stage (i.e. SRC1 to SRCn+4) of the gate driving part 310. In addition, a last stage is (n+3)-th stage SRCn+3. The (n+3)-th stage SRCn+3 is a dummy stage.

The third gate circuit 310*c* includes a plurality of stages. The third gate circuit 310*c* provides the (4k−1)-th gate line with gate signal based on the third clock signal CLK3, the seventh clock signal CLK7, the third vertical start signal STV3 and the off voltage VOFF. The seventh clock signal CLK7 has a phase opposite to the third clock signal CLK3.

Figure 10:
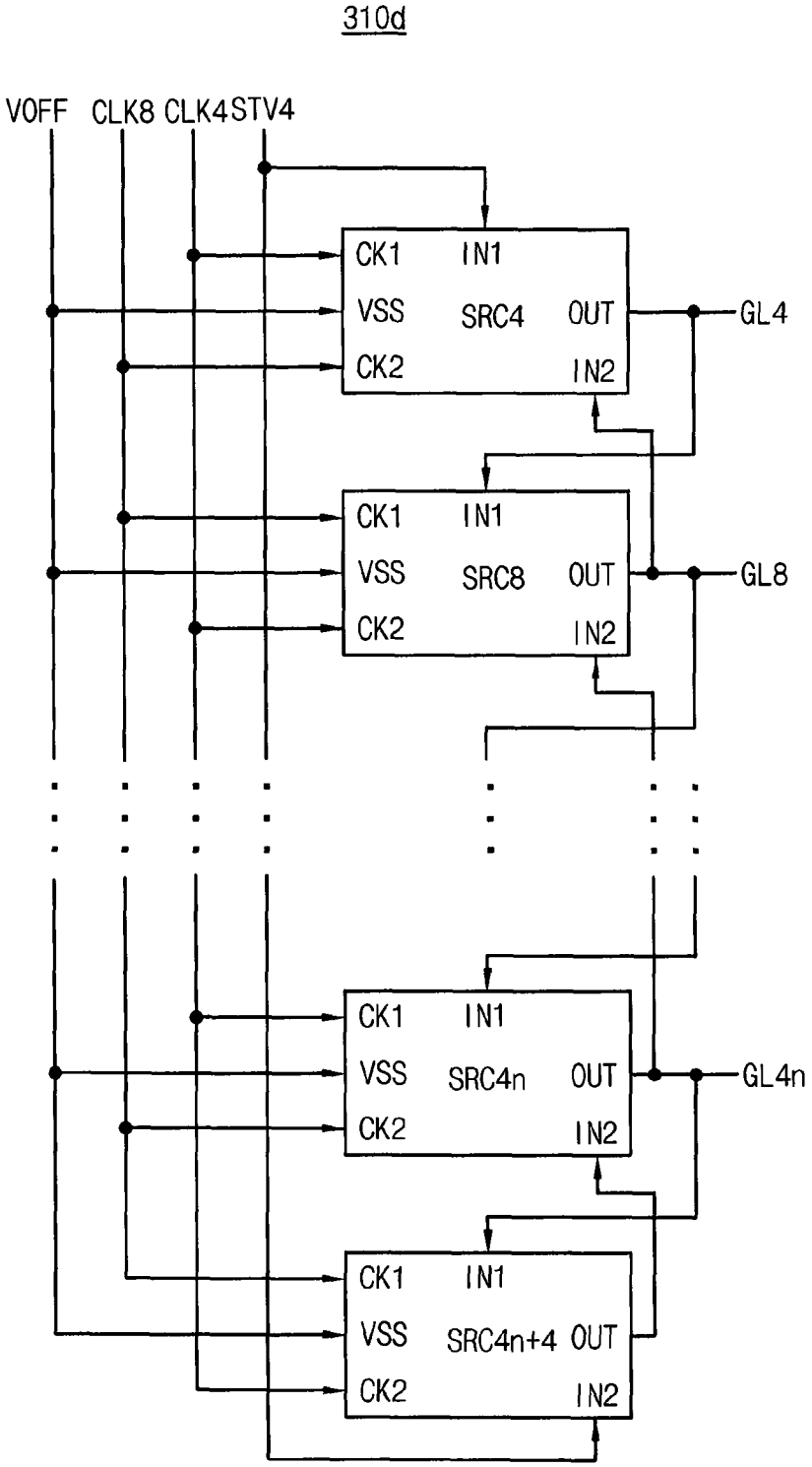

Referring to FIG. 10, the fourth gate circuit 310*d* may be defined as 4t-th stages ('t' is a natural number) cascade-connected one by one from the first to the (n+4)-th stage (i.e. SRC1 to SRCn+4) of the gate driving part 310. In addition, a last stage is (n+4)-th stage SRCn+4. The (n+4)-th stage SRCn+4 is a dummy stage.

The fourth gate circuit 310*d* includes a plurality of stages. The fourth gate circuit 310*d* provides the 4k-th gate line with a gate signal based on the fourth clock signal CLK4, the eighth clock signal CLK8, the fourth vertical start signal STV4 and the off voltage VOFF. The eighth clock signal CLK8 has a phase opposite to the fourth clock signal CLK4.

In the present exemplary embodiment, the display panel includes four gate circuits. However, the present inventive concept is not limited thereto. Alternatively, the display panel may include a multiple of four gate circuits.

Figure 11:
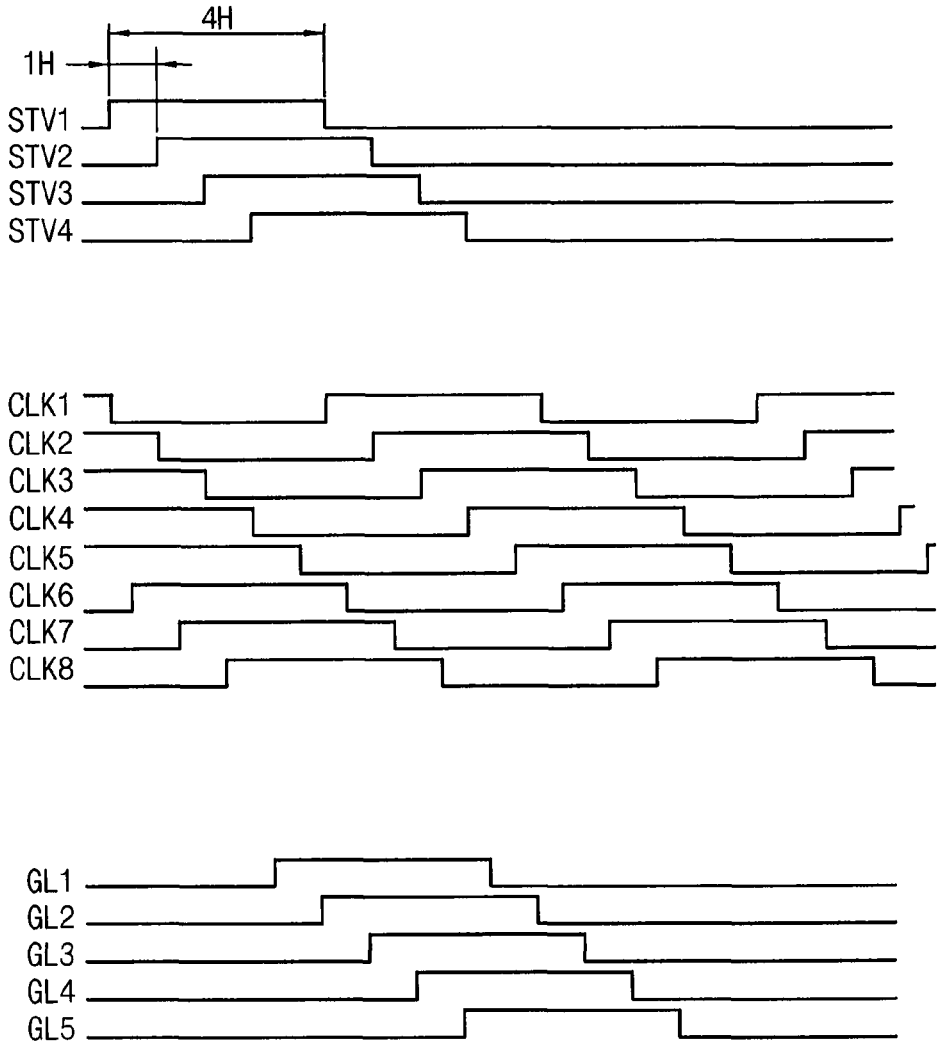
FIG. 11 is a waveform diagram illustrating an operation of a gate driving part according to an exemplary embodiment of the present inventive concept.
Figure 12:
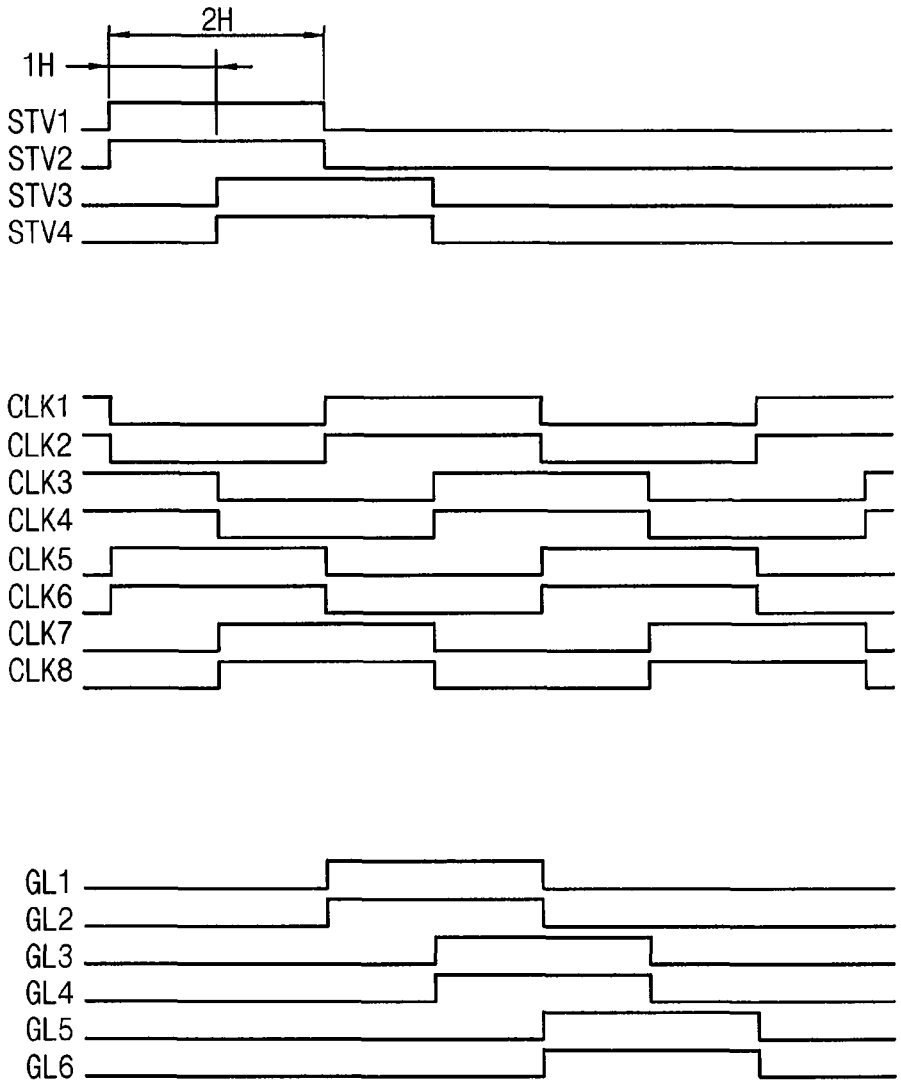
FIG. 12 is a waveform diagram illustrating an operation of a gate driving part according to an exemplary embodiment of the present inventive concept.

FIG. 11 is a waveform diagram illustrating an operation of a gate driving part according to an exemplary embodiment of the present inventive concept. FIG. 12 is a waveform diagram illustrating an operation of a gate driving part according to an exemplary embodiment of the present inventive concept.

The second gate circuit 310*b*, the third gate circuit 310*c* and the fourth gate circuit 310*d* have the same stage organization as the first gate circuit 310*a*. Thus, for convenience of description, an arbitrary stage driven by the first clock signal CLK1 and the fifth clock signal CLK5 will be explained as a representative.

Referring to FIGS. 7 and 11, a stage SRC may include a pull-up part, a pull-down part, a pull-up driving part, a ripple preventing part and a pull-down control part.

The pull-up part outputs a high period of the first clock signal CLK1 to the output terminal OUT to pull up the gate signal.

The pull-up part may include a first transistor. An input electrode of the first transistor is connected with the first clock terminal CK1. An output electrode of the first transistor is connected with the output terminal OUT. The pull-up part may further include a charging capacitor formed between a control electrode of the first transistor and the output electrode of the first transistor. The charging capacitor may store a high value of an output signal of the previous stage applied to the control electrode of the first transistor to turn on the first transistor. The charging capacitor may be defined by an overlapping region between the control electrode of the first transistor and the output electrode of the first transistor.

The pull-down part may include a first pull-down part and a second pull-down part. The first pull-down part may convert the gate signal output to the output terminal OUT in response to the fifth clock signal CLK5 to the off voltage VOFF. The second pull-down part may maintain the gate signal output to the output terminal OUT in response to the first clock signal CLK1 to the off voltage VOFF.

The first pull-up part may include a second transistor. An input electrode of the second transistor is connected with the voltage terminal VSS so that the off voltage VOFF is applied as an input. A control electrode of the second transistor is connected with the second clock terminal CK2, so that the fifth clock signal CLK5 is applied as an input. An output electrode of the second transistor is connected with the output terminal OUT. The second pull-up part may include a third transistor. An input electrode of the third transistor is connected with the voltage terminal VSS so that the off voltage VOFF is applied as an input. A control electrode of the third transistor is connected with a switching capacitor. An output electrode of the third transistor is connected with the output terminal OUT.

The pull-up driving part turns on the pull-up part in response to a high value of an output signal of the previous stage. The pull-up driving part turns off the pull-up part in response to a high value of output signal of the next stage.

The pull-up driving part may include a first pull-up driving part and a second pull-up driving part. The first pull-up driving part may include a fourth transistor. An input electrode and a control electrode of the fourth transistor are connected with the first input terminal IN1. An output electrode of the fourth transistor is connected with the control electrode of the first transistor. The control electrode of the firth transistor may be defined as a control electrode switching an on/off of the pull-up part. The second pull-up driving part may include a fifth transistor. An input electrode of the fifth transistor is connected with the voltage terminal VSS. An output electrode of the fifth transistor is connected with the control electrode of the first transistor. A control electrode of the fifth transistor is connected with the second input terminal IN2.

The fourth transistor is turned on in response to a high value of an output signal of the previous stage. Thereafter, the high value of an output signal of the previous stage is applied to a first nod and charged to the charging capacitor. An electric charge more than a threshold voltage of the first transistor is charged to the charging capacitor, and the first clock signal CLK1 having a low value is converted to the first clock signal CLK1 having a high value. Therefore, the second transistor is bootstrapped, so that the high value of the first clock signal CLK1 is outputted to the output terminal OUT.

Thereafter, the fifth transistor is turned on in response to a high value of an output signal of the next stage. An electric charge charged in the charging capacitor is discharged. Since the charging capacitor is discharged, a high value of the first nod is converted a low value of the first nod. Therefore, the first transistor is turned off, so that output of the first clock signal CLK1 is stopped.

The first transistor is turned off, and the second transistor is turned on in response to a high value of the fifth clock signal CLK5. Thereafter, a gate signal output to the output terminal OUT is converted to the off voltage VOFF. In addition, the third transistor is turned on in response to a high value of the first clock signal CLK1, and a signal output to the output terminal OUT is maintained as a low value. The second transistor and the third transistor is turned on alternately, so that the second transistor and the third transistor pull down the gate signal output to the output terminal OUT to a low value.

The ripple preventing part may maintain the first nod as the off voltage VOFF. Thus, a ripple of the first nod due to a coupling of the first clock signal CLK1 may be prevented.

The ripple preventing part may include a sixth transistor. An input electrode of the sixth transistor is connected with the voltage terminal VSS so that the off voltage VOFF is applied as an input. A control electrode of the sixth transistor is connected with the switching capacitor, so that the first clock signal CLK1 is applied as an input. An output electrode of the sixth transistor is connected with the first nod. In the ripple preventing part, the sixth transistor is turned on in response to a high value of the first clock signal CLK1. Thereafter, the off voltage VOFF is applied to the first nod.

The pull-down control part may turn off the ripple preventing part in response to a signal of the first nod.

The pull-down control part may include a seventh transistor. An input electrode of the seventh transistor is connected with the voltage terminal VSS so that the off voltage VOFF is applied as an input. An output electrode of the seventh transistor is connected with a second nod. A control electrode of the seventh transistor is connected with the first nod. When a high value of the first clock signal CLK1 is applied to the second nod, and when a signal of the first nod has a high value, the seventh transistor is turned on. Thus, a high value of the second nod may be converted to a low value of the second nod.

One electrode of the switching capacitor is connected with the first clock terminal CK1. The other electrode of the switching capacitor is connected with a control electrode of the third and the sixth transistor and an output electrode of the seventh transistor. The switching capacitor composes the second nod. The switching capacitor stores the first clock signal CLK1 to be applied to the second nod. Therefore, the third and the sixth transistor may be turned on or turned off.

Here, the first clock signal CLK1 and the fifth clock signal CLK5 have a period of 4H (where 'H' is a horizontal period). The fifth clock signal CLK5 has a phase opposite to the first clock signal CLK1. The first gate circuit 310*a* provides the (4k−3)-th gate line with gate signal having a pulse width of 4H.

Referring to FIG. 11, a first vertical start signal STV1, a second vertical start signal STV2, a third vertical start signal STV3, a fourth vertical start signal STV4 have a pulse width of 4H and are sequentially delayed by 1H. Therefore, a first gate circuit 310*a*, a second gate circuit 310*b*, a third gate circuit 310*c* and a fourth gate circuit 310*d* initiate an operation of output of a gate signal sequentially delayed by 1H.

A first clock signal CLK1, a second clock signal CLK2, a third clock signal CLK3, a fourth clock signal CLK4, a fifth clock signal CLK5, a sixth clock signal CLK6, a seventh clock signal CLK7 and an eighth clock signal CLK8 have a pulse width of 4H and a cycle of 8H. The first clock signal CLK1, the second clock signal CLK2, the third clock signal CLK3 and the fourth clock signal CLK4 are sequentially delayed by 1H. The first clock signal CLK1, the second clock signal CLK2, the third clock signal CLK3 and the fourth clock signal CLK4 are applied as a low value in synchronizing with the first vertical start signal STV1, the second vertical start signal STV2, the third vertical start signal STV3 and the fourth vertical start signal STV4, respectively. The fifth clock signal CLK5, a sixth clock signal CLK6, a seventh clock signal CLK7 and an eighth clock signal CLK8 have a phase opposite to the first clock signal CLK1, the second clock signal CLK2, the third clock signal CLK3 and the fourth clock signal CLK4, respectively.

The first gate circuit 310*a*, the second gate circuit 310*b*, the third gate circuit 310*c* and the fourth gate circuit 310*d* output gate signals to corresponding gate lines. The first gate circuit 310*a*, the second gate circuit 310*b*, the third gate circuit 310*c* and the fourth gate circuit 310*d* initiate an operation of outputting a gate signal in synchronizing with the first vertical start signal STV1, the second vertical start signal STV2, the third vertical start signal STV3 and the fourth vertical start signal STV4, respectively. The first gate circuit 310*a*, the second gate circuit 310*b*, the third gate circuit 310*c* and the fourth gate circuit 310*d* output gate signals based on two clock signals having an opposing phase. Therefore, gate signals having a pulse width of 4H output to the gate lines sequentially, so that a timing margin of each gate signal may be ensured.

Referring to FIG. 12, a first vertical start signal STV1, a second vertical start signal STV2, a third vertical start signal STV3, and a fourth vertical start signal STV4 have a pulse width of 2H and every two subsequent vertical start signals are sequentially delayed by 1H. For example, the first vertical start signal STV1 and the second vertical start signal STV2 are applied simultaneously and the third vertical start signal STV3 and the fourth vertical start signal STV4 are applied simultaneously.

A first clock signal CLK1, a second clock signal CLK2, a third clock signal CLK3, a fourth clock signal CLK4, a fifth clock signal CLK5, a sixth clock signal CLK6, a seventh clock signal CLK7 and an eighth clock signal CLK8 have a pulse width of 2H and a cycle of 4H. Among the first clock signal CLK1, the second clock signal CLK2, the third clock signal CLK3 and the fourth clock signal CLK4, every two subsequent clock signals are sequentially delayed by 1H. For example, a same timing is applied to the first clock signal CLK1 and the second clock signal CLK2, and a same timing is applied to the third clock signal CLK3 and the fourth clock signal CLK4. The first clock signal CLK1, the second clock signal CLK2, the third clock signal CLK3 and the fourth clock signal CLK4 are applied as a low value in synchronizing with the first vertical start signal STV1, the second vertical start signal STV2, the third vertical start signal STV3 and the fourth vertical start signal STV4, respectively. The fifth clock signal CLK5, a sixth clock signal CLK6, a seventh clock signal CLK7 and an eighth clock signal CLK8 have a phase opposite to the first clock signal CLK1, the second clock signal CLK2, the third clock signal CLK3 and the fourth clock signal CLK4, respectively.

The first gate circuit 310*a*, the second gate circuit 310*b*, the third gate circuit 310*c* and the fourth gate circuit 310*d* output gate signals to corresponding gate lines. The first gate circuit 310*a*, the second gate circuit 310*b*, the third gate circuit 310*c* and the fourth gate circuit 310*d* initiate an operation of outputting gate signals in synchronizing with the first vertical start signal STV1, the second vertical start signal STV2, the third vertical start signal STV3 and the fourth vertical start signal STV4, respectively. The first gate circuit 310*a*, the second gate circuit 310*b*, the third gate circuit 310*c* and the fourth gate circuit 310*d* output gate signals based on two clock signals having an opposing phase. Therefore, gate signals having a pulse width of 2H are outputted to every two gate lines sequentially, so that a timing margin of each gate signal may be ensured.

According to the present exemplary embodiment, the display device has a multiple of 2-dot-crossed pixel structures and a plurality of 4 gate circuits. In addition, the display device is driven by a method in which each of the clock signals is sequentially delayed by 1H and a method in which, among the clock signals, every two subsequent clock signals are sequentially delayed by 1H. Therefore, the display device may be driven at both frequencies of 120 Hz and 240 Hz.

The foregoing is illustrative of the present invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A display device comprising:

a plurality of pixels arranged in a column direction and a row direction;

a plurality of data lines of which each data line is connected to the pixels of two consecutive rows arranged alternately with the pixels of two adjacent consecutive rows; and a plurality of gate circuit parts of which each gate circuit part is configured to apply a gate signal to a gate line, wherein the plurality of gate circuit parts include:

a first, a second, a third, and a fourth gate circuit part, a first clock-terminal signal of the first, the second, the third and the fourth gate circuit part is a first, a second, a third and a fourth clock signal inverted every 4H ('H' is a horizontal period) respectively, and a second clock-terminal signal of the first, the second, the third and the fourth gate circuit part is a fifth, a sixth, a seventh and an eighth clock signal having a phase opposite to the first, the second, the third and the fourth clock signal respectively.

2. The display device of claim 1, further comprising:

a data driving part configured to apply data signals to the data lines.

3. The display device of claim 2, wherein the data driving part applies a data signal having a first polarity to an (n+1)-th data line ('n' is a natural number), and applies a data signal having a second polarity to each of an n-th data line and an (n+2)-th data line adjacent to the (n+1)-th data line during one frame.

4. The display device of claim 1, wherein the first, the second, the third and the fourth clock signals are delayed by 1H sequentially.

5. A display device comprising:

a plurality of pixels arranged in a column direction and a row direction;

a plurality of data lines of which each data line is connected to the pixels of two consecutive rows arranged alternately with the pixels of two adjacent consecutive rows; and a plurality of gate circuit parts of which each gate circuit part is configured to apply a gate signal to a gate line, wherein the plurality of gate circuit parts include:

a first, a second, a third, and a fourth gate circuit part, a first, a second, a third and a fourth clock signal inverted every 2H ('H' is a horizontal period) are applied to the first, the second, the third and the fourth gate circuit part respectively, and a fifth, a sixth, a seventh and an eighth clock signal having a phase opposite to the first, the second, the third and the fourth clock signal are applied to the first, the second, the third and the fourth gate circuit part respectively.

6. The display device of claim 5, wherein the first clock signal and the second clock signal are applied simultaneously, and the third clock signal and the fourth clock signal are delayed by 1H with respect to the first clock signal and the second clock signal.

7. The display device of claim 1, wherein the first, second, third, and fourth gate circuit part each comprises an amorphous silicon gate (ASG).

8. The display device of claim 1, wherein the first, second, third, and fourth gate circuit part each comprises an integrated circuit (IC).

9. A display device comprising:

a plurality of pixels arranged in a column direction and a row direction;

a plurality of data lines of which each data line is connected with the pixels of four consecutive rows arranged alternately with the pixels of four adjacent consecutive rows; and a plurality of gate circuit parts of which each gate circuit part is configured to apply a gate signal to a gate line, wherein the plurality of gate circuit parts include:

a first, a second, a third, and a fourth gate circuit part, a first clock-terminal signal of the first, the second, the third and the fourth gate circuit part is a first, a second, a third and a fourth clock signal inverted every xH ('H' is a horizontal period), respectively, where x is either 2 or 4,and a second clock-terminal signal of the first, the second, the third and the fourth gate circuit part is a fifth, a sixth, a seventh and an eighth clock signal having a phase opposite to the first, the second, the third and the fourth clock signal respectively.

10. The display device of claim 9, further comprising:

a data driving part configured to apply a data signal to the data lines.

11. The display device of claim 10, wherein the data driving part applies a data signal having a first polarity to an (n+1)-th data line ('n' is a natural number), and applies a data signal having a second polarity to each of an n-th data line and an (n+2)-th data line adjacent to the (n+1)-th data line during one frame period.

12. The display device of claim 9, wherein the first, the second, the third and the fourth clock signal are delayed by 1H sequentially.

13. The display device of claim 9, wherein the first clock signal and the second clock signal are applied simultaneously, and the third clock signal and the fourth clock signal are delayed by 1H with respect to the first clock signal and the second clock signal.

14. The display device of claim 9, wherein the plurality of gate circuit parts include a first, a second, a third, and a fourth gate circuit part of which each comprises an amorphous silicon gate (ASG).

15. The display device of claim 9, wherein the plurality of gate circuit parts include a first, a second, a third, and a fourth gate circuit part of which each comprises an integrated circuit (IC).

* * * * *